United States Patent [19]

Rice

[11] 4,343,661

[45] Aug. 10, 1982

[54] METHOD OF MAKING A LOW TEMPERATURE BAINITE STEEL ALLOY GEAR

[75] Inventor: Stuart L. Rice, Morton, Ill.

[73] Assignee: Caterpillar Tractor Co., Peoria, Ill.

[21] Appl. No.: 142,326

[22] Filed: Apr. 21, 1980

Related U.S. Application Data

[62] Division of Ser. No. 965,534, Nov. 15, 1978, Pat. No. 4,225,365.

[51] Int. Cl.[3] ..... C21D 1/20; C21D 9/32

[52] U.S. Cl. ..... 148/134; 148/143

[58] Field of Search ..... 148/3, 12 R, 12 F, 12 B, 148/12.4, 134, 143, 144, 36, 147; 75/123 B, 123, 123 J, 126 C; 266/120

[56] References Cited

U.S. PATENT DOCUMENTS

| | | | |
|---|---|---|---|
| 1,924,099 | 8/1933 | Bain et al. | 148/143 |
| 2,128,621 | 8/1938 | Queneau | 148/14 |
| 2,791,500 | 5/1957 | Foley et al. | 148/143 |
| 2,814,580 | 11/1957 | Hoover | 148/36 X |
| 3,196,052 | 7/1965 | Hann | 148/12 R |
| 3,298,827 | 1/1967 | Jatczak | 75/128 W |
| 3,303,061 | 2/1967 | Wilson | 148/12.3 |
| 3,340,102 | 9/1967 | Kulin et al. | 148/12 F X |
| 3,348,981 | 10/1967 | Goda et al. | 148/36 |
| 3,366,471 | 1/1968 | Hill et al. | 75/123 R |
| 3,528,088 | 9/1970 | Seghezzi et al. | 148/143 |
| 3,663,316 | 5/1972 | Kulmburg | 148/36 |
| 3,666,572 | 5/1972 | Nakagawa et al. | 148/12 B X |
| 3,806,378 | 4/1974 | Bramfitt et al. | 148/12 F |
| 3,854,363 | 12/1974 | Merkell et al. | 75/126 C X |
| 3,907,614 | 9/1975 | Bramfitt et al. | 148/36 |
| 4,077,812 | 3/1978 | Tani | 148/36 X |
| 20128,621 | 8/1938 | Queneau | 148/14 |

FOREIGN PATENT DOCUMENTS

| | | | |
|---|---|---|---|
| 525364 | 5/1956 | Canada | 148/143 |
| 1080304 | 8/1967 | United Kingdom | 148/36 |

*Primary Examiner*—Peter K. Skiff

*Attorney, Agent, or Firm*—Charles E. Lanchantin, Jr.

[57] ABSTRACT

A method of making a low temperature bainite steel alloy gear includes forming a toothed gear having preferably preselected weight percentages of carbon, manganese, silicon, molybdenum, boron and the balance substantially iron, heating the gear to assure a substantially complete austenite morphology, quenching the gear toward a preselected temperature and avoiding transformation, and then holding the gear at the preselected temperature less than about two hours and transforming the austenite directly to substantially complete lower temperature bainite. Energy is saved by the short holding time and the usual further processing of the gear is avoided.

6 Claims, 2 Drawing Figures

METHOD OF MAKING A LOW TEMPERATURE BAINITE STEEL ALLOY GEAR

This is a division of Ser. No. 965,534, filed Nov. 15, 1978, now U.S. Pat. No. 4,225,365.

TECHNICAL FIELD

This invention relates generally to an effective and energy-conserving method of making a low temperature bainite steel alloy gear.

BACKGROUND ART

Carburized and hardened alloy steel gears are widely used for vehicle power trains in order to obtain a sufficient resistance to surface pitting and high bending loads, and thereby a generally desirable service life. However, the heat treating and processing of such gears takes a long time, uses a considerable amount of energy and, accordingly, the gears are expensive. Drastic quenching of the gears is also often required, which results in considerable distortion. Moreover, even with such extensive processing, the microstructure of the gears is inhomogeneous and the gears lack sufficient case toughness at the desired high hardness levels. Likewise, nitrided alloy steel gears are relatively brittle at relatively high hardness levels, for example, above a magnitude of about 58 on the Rockwell C hardness scale (Rc58), and do not exhibit a relatively uniform metallographic structure.

The properties of some bainitic alloy steels are very desirable as a substitute for the above-mentioned martensitic steels. For example, in high carbon steels low temperature bainite is more ductile than martensite at the same hardness level. But most prior art bainitic alloy steels have utilized controlled amounts of potentially critical and/or expensive materials such as chromium and nickel. Exemplary of the art in this area are the following U.S. Pat. Nos.: 3,418,178 to S. A. Kulin et al on Dec. 24, 1968; 3,303,061 to J. E. Wilson on Feb. 7, 1967; 2,128,621 to B. R. Queneau on Aug. 30, 1938; 3,298,827 to C. F. Jatczak on Jan. 17, 1967; 3,348,981 to S. Goda et al on Oct. 24, 1967; 3,366,471 to M. Hill et al on Jan. 30, 1968; 3,418,178 to S. A. Kulin et al on Dec. 24, 1968; 3,528,088 to H. Seghezzi et al on Sept. 8, 1970; and 3,907,614 to B. L. Bramfitt et al on Sept. 23, 1975. A considerable portion of the available carbon is tied up by the critical alloy in the aforementioned patent references so that a relatively coarse crystallographic texture is formed that is detrimental to the toughness and hardness of the final article. Another disadvantage is that when such critical alloys are utilized, the austenite transformation temperature is generally raised, thereby requiring increased amounts of energy and adding to the processing costs.

U.S. Pat. No. 1,924,099 issued to E. C. Bain et al on Aug. 29, 1933 describes a process known as austempering. Such process involves the steps of: (a) heating a steel article above an upper critical temperature to assure a change in the morphology of the article to substantially 100% austenite; (b) quenching the article below approximately 540° C. (1000° F.), but above the temperature of martensite formation or the so-called martensite start ($M_s$) line; and (c) holding the steel article at such an intermediate temperature for a preselected period of time sufficient to convert the morphology of the article to a form other than 100% martensite. While time-temperature-transformation (TTT) diagrams are known on various prior art steels, the alloy compositions and austempering processes resorted to have suffered two general deficiencies. Firstly, the quenching step has involved cooling at a rate such that the transforming start ($T_s$) curve of the alloy has been crossed and undesirable upper transformation products such as proeutectoid ferrite/carbide, pearlite, and upper bainite formed. This is due to a major degree to the relatively critical time period of the alloy to the usual nose portion of the transformation start curve. The undesirable crossover of such nose portion results in a loss of toughness and hardness. Secondly, the heat treat holding times sufficient to obtain substantially complete transformation have been too long, for example, five hours or more. For general commercial applications, such an extended holding period is substantially impractical and represents a considerable waste of energy and time.

Still another factor of major importance is that as the body of the article to be produced increases in thickness, its cooling rate decreases. As a consequence, although thin nails or the like having an appreciable proportion of lower temperature bainite may have been made because such articles could be rapidly cooled in a practical manner, it is believed that the prior art TTT diagrams of the materials of such articles would not permit the practical production of a substantially complete lower temperature bainite morphology when the section thickness is increased to about 12 mm (½"), for example. Thus, the composition taught by U.S. Pat. No. 3,528,088 to H. Seghezzi et al on Sept. 8, 1970 is not desirable for an article thicker than about 12 mm (½") because the austempered morphology of the article would vary nonuniformly across its cross section away from substantially complete lower bainite, and the hardness would undesirably drop below a magnitude level of about 55 to 58 on the Rockwell C scale. The anchoring device of the Seghezzi patent also undesirably utilizes the potentially critical element chromium. U.S. Pat. No. 3,196,052 to K. G. Hann on June 28, 1961 is representative of another alloy steel for a thin wire that has substantially the same problems.

In some instances, such as in U.S. Pat. No. 2,814,580 to H. D. Hoover on Nov. 26, 1957, processing of certain steel alloys has been accomplished at a holding temperature which is above the level of lower bainite formation. In other instances, although a lower holding temperature may have been established, austenite, pearlite, upper bainite or martensite have been undesirably present to an excessive proportion in comparison with the lower temperature bainite, for example, above an individual or collective proportion of about 10 Vol.%.

The present invention is directed to overcoming one or more of the problems as set forth above.

DISCLOSURE OF INVENTION

In accordance with one aspect of the present invention, a low temperature bainite alloy steel article is provided having carbon in the range of 0.60 to 0.80 wt.%, manganese in the range of 0.45 to 1.00 wt.%, silicon in the range of 0.15 to 2.20 wt.%, molybdenum in the range of 0.40 to 0.70 wt.%, and the balance substantially iron, with the article having a substantially complete low temperature bainite morphology.

In accordance with another aspect of the present invention, a low temperature bainite steel alloy gear is made by forming a toothed gear of an alloy steel consisting essentially of carbon, manganese, silicon, molybdenum, preferably but not essentially boron, and the balance substantially iron, heating the gear to the austenite transformation temperature range to assure a substantially complete austenite morphology, quenching it toward a preselected temperature, holding the gear at the preselected temperature for less than about two hours to substantially complete transformation of the alloy directly from austenite to low temperature bainite. Subsequent cooling of the article can result in a through-hardness level of a magnitude in excess of $R_c57$ and a relatively high tensile strength.

In accordance with still another aspect of the invention, a drive train gear is formed of alloy steel having a substantially complete low temperature bainite microstructure.

BEST MODE FOR CARRYING OUT THE INVENTION

Figure 1:
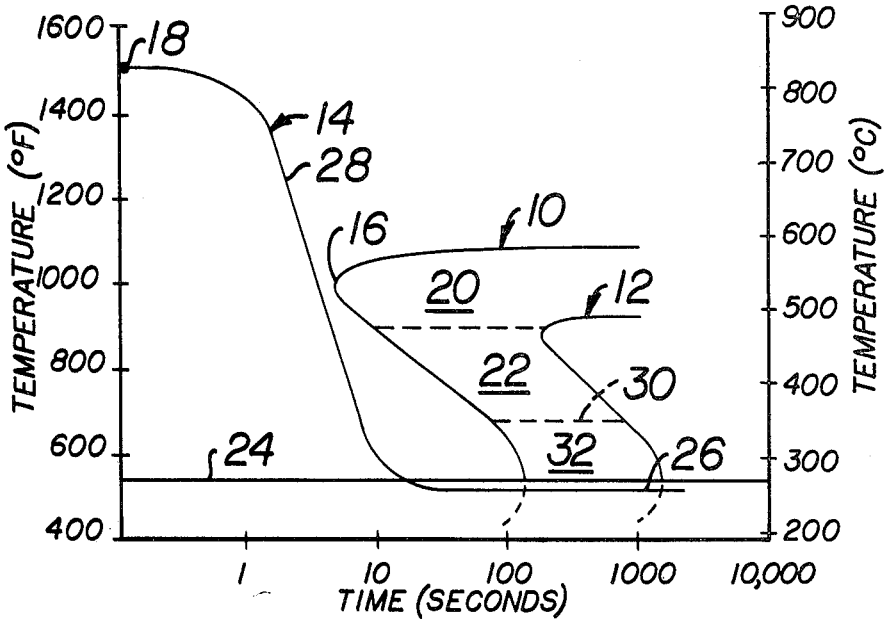
FIG. 1 is a diagrammatic time-temperature-transformation diagram for a first example bainitic alloy steel article of the present invention and including a heat treatment processing route.

The composition of the low temperature bainitic alloy steel article according to the present invention consists essentially of the following elements in the proportions indicated:

| Elements | Broad Range (Wt. %) | Preferred Range (Wt. %) | Most Desirable Amount (Wt. %) |
|---|---|---|---|
| Carbon | 0.60–0.80 | 0.65–0.75 | 0.70 |
| Manganese | 0.45–1.00 | 0.60–0.70 | 0.65 |
| Silicon | 0.15–2.20 | 1.20–2.00 | 1.50 |
| Molybdenum | 0.40–0.70 | 0.50–0.60 | 0.55 |
| Iron | Remainder | Remainder | Remainder |

Preferably, but I believe not essentially, boron in the broad range of 0.0003 to 0.004 wt.% is controllably added to the above-designated composition. More particularly, a boron range of 0.002 to 0.0035 wt.% is preferred, and the most desirable amount is about 0.003 wt.%.

In the composition of the novel alloy steel of this invention carbon (C) is present in the relatively high amounts indicated to impart the desired strength and hardness throughout the body of the article. Carbon is an austenite former, and is present in the minimum amount stated to assure that a relatively uniform through-hardness value of a magnitude in excess of about $R_c56$ on the Rockwell C hardness scale can be obtained in the finished article. Below the value of about 0.60 wt.% the alloy would lack sufficient hardness and strength. Above the value of about 0.80 wt.% the alloy would become less ductile and/or too brittle, and the amount of carbon present would undesirably contribute to the formation of free carbides. Moreover, the range of carbon set forth assures that substantially complete transformation to low temperature bainite can be positively obtained.

Manganese (Mn) is also an austenite former and ferrite strengthener. Below the minimum established value of about 0.45 wt.% the strength and hardness of the article produced would be lower than that desired, and there would not be enough manganese to tie up at least some of the sulfur usually present in residual amounts and to form manganese sulfide rather than undesirable iron sulfide. Above the maximum established value of about 1.00 wt.% the ductility of the article would be lowered excessively.

Silicon (Si) is also a ferrite strengthener and is effective in the amounts indicated to assure the desired tensile strength and hardness of the final low temperature bainite alloy, as well as for grain size control. Below a minimum value of about 0.15 wt.% would be insufficient for deoxidation purposes and for the desired level of hardness in the range of magnitude above about $R_c56$. Above a maximum value of about 2.20 wt.% the toughness decreases to the point where excessive embrittlement occurs, and graphite tends to form.

Molybdenum (Mo) reduces graphitization, is a ferrite strengthener, and provides the desired hardenability characteristics to the low temperature bainite alloy. In general, the stated amounts of carbon, manganese, silicon, and molybdenum serve to lower the martensite start ($M_s$) transformation portion of the process route permitting the lower bainite transformation to occur at a relatively low holding temperature for increased hardenability of the article and at a savings in energy. Furthermore, these four elements optimize the position of the transformation start curve so that quenching does not have to be achieved at an excessive rate. More specifically, the nose portion of the transformation start curve is thereby desirably located to the right on the TTT diagram sufficient to allow quenching of articles of thicker cross section at a more practical rate that will minimize distortion of the article and still result in relatively uniform through-hardening thereof. Below a minimum value of about 0.40 wt.% molybdenum hardness undesirably decreases and the transformation start curve is too far to the left so that quench rate problems arise. On the other hand, above a maximum value of about 0.70 wt.% of molybdenum the transformation completed curve is located too far to the right on the TTT diagram, resulting in an extended required holding time of above two hours and a corresponding waste of energy.

Boron (B) improves bainite hardenability. The addition of boron (B) is preferred because the boron plus molybdenum plus silicon conserve these elements and provide a more advantageous rightward position of the transformation start curve and to thereby permit more practical cooling rates for articles of various thickness during austempering. Boron and molybdenum and possibly silicon retard the polygonal ferrite reaction without retarding the bainitic ferrite reaction. Furthermore, the boron acts as an intensifier from the standpoint that it intensifies the reaction of the other major elements. Boron is present in the minimum amount indicated to enable the proportions of molybdenum and/or manganese to be disproportionately reduced for economy, while simultaneously providing the desired morphology. However, going above the maximum value of about 0.004 wt.% is believed detrimental to toughness.

Some undesirable residual elements, such as sulfur (S) and phorphorus (P) are usually present in commercial steels. On the other hand, other residual elements, such as copper (Cu), chromium (Cr), titanium (Ti), etc. may also be present in relatively small amounts with some degree of benefit. However, all of these residual elements should be individually limited to less than 0.30 wt.%, and preferably limited to less than 0.20 wt.%.

A first example of the low temperature bainite steel alloy of the present invention has the following composition:

| Element | Wt. % |
|---|---|
| C | 0.62 |
| Mn | 0.64 |
| Si | 0.29 |
| Mo | 0.46 |
| B | 0.0011 |
| Cr | 0.07 |
| Ni | 0.03 |
| Cu | 0.03 |
| P | 0.02 |
| S | 0.006 |
| Al | <0.01 |
| V | 0.001 |
| Fe | Remainder |

A second example of the low temperature bainite steel alloy of the present invention has the following composition:

| Element | Wt. % |
|---|---|
| C | 0.66 |
| Mn | 0.68 |
| Si | 1.35 |
| Mo | 0.43 |
| B | 0.0014 |
| Cr | 0.08 |
| Ni | 0.03 |
| P | 0.02 |
| S | 0.004 |
| Al | <0.01 |
| V | 0.002 |
| Fe | Remainder |

A third example has the following composition:

| Element | Wt. % |
|---|---|
| C | 0.76 |
| Mn | 0.62 |
| Si | 0.38 |
| Mo | 0.51 |
| B | 0.0021 |
| Cu | 0.12 |
| Cr | 0.09 |
| Ti | 0.059 |
| Ni | 0.04 |
| S | 0.027 |
| P | 0.013 |
| V | 0.011 |
| Zr | 0.005 |
| Al | <0.01 |
| Fe | Remainder |

A fourth example has the following composition:

| Element | Wt. % |
|---|---|
| C | 0.72 |
| Mn | 0.65 |
| Si | 2.02 |
| Mo | 0.54 |
| B | 0.0033 |
| Cu | 0.17 |
| Ti | 0.15 |
| Cr | 0.14 |
| Ni | 0.06 |
| Al | 0.047 |
| S | 0.019 |
| P | 0.015 |
| V | 0.014 |
| Zr | 0.006 |

-continued

| Element | Wt. % |
|---|---|
| Fe | Remainder |

The first example lower bainite alloy steel embodiment set forth above had a TTT diagram as illustrated in FIG. 1, including a transformation start curve 10 and a transformation complete curve 12. A heat treatment processing route 14, therefor, is also shown, and it is to be noted that the processing route desirably avoids intersection with a nose portion 16 of the transformation start curve.

More particularly, the processing route 14 for making an article of the first example composition included the initial formation of a 76 mm×76 mm (3"×3") ingot and subsequently rolling and/or forging the ingot down to a 38 mm×38 mm (1½"×1½") bar. The bar was heated to a preselected first temperature 18 within the austenite transformation temperature range. For the first example composition the lower end of such temperature range, often referred to as the upper critical temperature, was about 770° C. (1420° F.), so that the preselected first temperature was established above that limit at about 820° C. (1510° F.). Preferably the bar is heated in a salt bath. In the instant example the bar was most desirably heated in a nontoxic, electrically heated chloride salt bath to the approximate preselected first temperature point 18 noted in FIG. 1. The bar was maintained at such temperature for about 5 to 10 minutes to assure a substantially complete austenite microstructure.

The second step after heating the bar to the preselected first temperature 18 is to relatively rapidly cool or quench the heated bar is indicated in FIG. 1 while missing the nose portion 16 of the transformation start curve 10 particular to the alloy steel composition of the present invention. If the heated bar is quenched toward a preselected second temperature 26 too slowly, a significant portion of the microstructure would be undesirably transformed to pearlite because the processing route would pass through a pearlite region 20 between curves 10 and 12 as indicated in FIG. 1. If it is quenched at a slightly faster rate in a bath of a higher temperature, then an undesirable upper bainite microstructure could be formed because the processing route would pass through an upper bainite region 22 as shown in FIG. 1. Thus, it may be appreciated that it is imperative to transform the austenite microstructure of the bar or similar article directly to a lower bainite microstructure by choosing a preselected cooling rate 28 sufficient for avoiding crossing of the transformation start curve 10 until reaching a preselected lower range of temperatures. Preferably, the lower end of such lower bainite range is defined by a preselected second temperature 26 located within a band of temperatures adjacent the $M_s$ line 24 for the composition of elements selected in order to maximum the final hardness of the article. For example, I prefer that the preselected second temperature 26 be limited to less than about 15° C. (30° F.) above or below the $M_s$ line. The preselected second temperature should be above the $M_s$ line if it is desired to substantially avoid transformation to martensite. However, even if such temperature is below the $M_s$ line by the amount indicated, I believe that the percentage of martensite formation will be limited to less than about 10 Vol. %. The $M_s$ temperature for the first example alloy was about 270° C. (520° F.), and the preselected second temperature 26 chosen was 260° C. (500° F.). The upper end of the lower bainite range is defined by a preselected third temperature 30 of about 350° C. (660° F.). If the preselected third temperature is raised to a higher temperature, the alloy may be transformed at least in part into an upper bainite microstructure with its undesirable coarser grain structure. In view of the above-stated considerations, the bar is preferably quenched in a second salt bath having the preselected second temperature 26. In the instant example the bar was quenched in a nontoxic, electrically heated nitrate-nitrite salt bath at the preselected cooling rate 28 indicated in FIG. 1. It is of note to appreciate that the time scale along the bottom of FIG. 1 is of advantageous logarithmic form, so that in this way the cooling rate 28 approximates a substantially straight line throughout a significant portion of the first 10 seconds or so of the processing route 14. In the instant example the second salt bath was maintained at a quenchant temperature of about 260° C. (500° F.), and approximately 0.6 wt. % water was added to the salt bath for greater quench severity.

The third step of the processing route 14 is to hold or maintain the bar at a relatively stable temperature between the above-mentioned lower and upper temperature reference lines 26 and 30 for a preselected period of time just prior to the transformation start curve 10 and thereafter to the transformation complete curve 12 to complete the transformation of the alloy steel to a substantially complete low temperature bainite microstructure. By this term it is meant that there is less than 10 Vol. % of retained austenite, substantially no pearlite, and less than about 10 Vol. % transformation to martensite in the subject lower bainite alloy steel. Since the hardness of the article increases as the holding temperature approaches the $M_s$ line 24, it is desirable to maintain the bar or article at or adjacent the preselected second temperature 26. In the instant example, such isothermal heat treat transformation is complete when the processing route 14 reaches the transformation complete curve 12. Thus, the tranformation start and complete curves 10 and 12 define the left and right time-indicating boundaries of a lower bainite transformation region 32, while the lines 26 and 30 define the lower and upper temperature boundaries of the same region which varies in a range of about 250° C. (482° F.) to 350° C. (660° F.) for the subject alloy. Advantageously, the time scale along the bottom of the lower bainite transformation region 12 indicates that the length of holding time required for the first example alloy steel is only about 1800 seconds. This is a great improvement over the extended holding time period of prior art. On the other hand, for reduced hardness applications the holding time can be reduced to about 800 seconds by raising the temperature of the second salt bath and the subsequent holding temperature to a point adjacent the line 30 in order to save energy and time.

The fourth step of the processing route 14 not shown in the drawing, is to remove the article from the second salt bath and allow air cooling thereof at substantially ambient temperatures. Such step is taken after the transformation complete curve 12 has been breached by the processing route.

Figure 2:
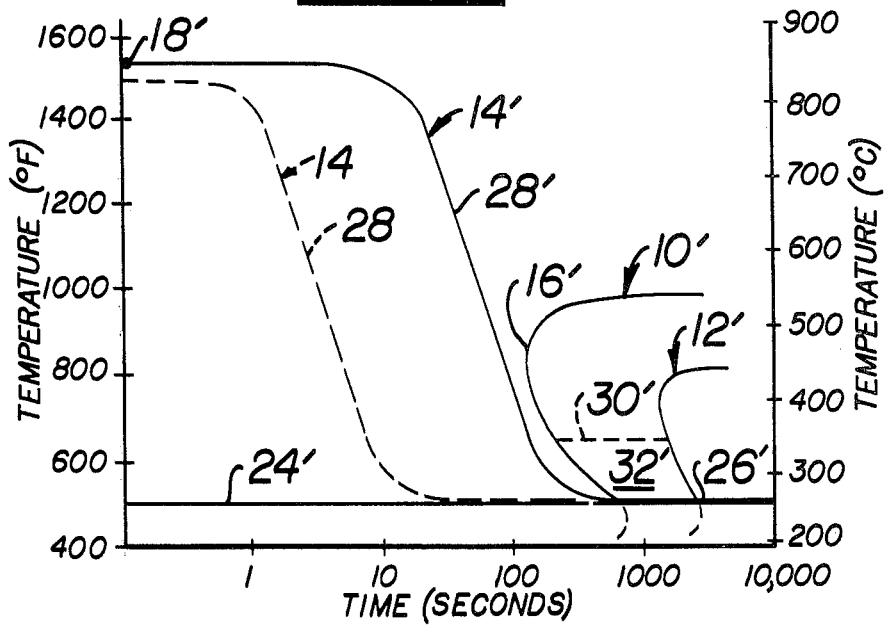
FIG. 2 is a second diagram of the type illustrated in FIG. 1, of a second example bainitic alloy steel article made in accordance with the present invention.

The second example of the low temperature bainitic alloy steel set forth above was advantageously so constructed as to move the transformation start and transformation complete curves 10 and 12 to the right when looking at the time-temperature-transformation diagrams as may be noted by comparing the second example diagram of FIG. 2 with that of FIG. 1. This is advantageous for allowing the article to be cooled at a slower or more practical rate by quenching, as would be the case for an article having a thicker cross section, and yet would still assure positive attainment of a substantially complete lower temperature bainite microstructure. The second example had a relatively higher proportion of silicon, an upper critical temperature of about 800° C. (1470° F.), and a martensite start ($M_s$) temperature of about 260° C. (500° F.). Accordingly, the preselected first temperature 18 to assure substantially complete austenite formation of the second example was about 850° C. (1560° F.), the preselected second temperature was about 260° C. (500° F.), and the curves and regions corresponding to those of FIG. 1 are identified with the same reference numerals with prime indicators appended thereto.

In viewing FIG. 2, note that the length of the holding time required at or adjacent the preselected second temperature 26' for complete lower temperature bainite transformation is still only about 2400 seconds, or two-thirds of an hour. More importantly, the quench severity necessary to avoid the nose portion 16' has been appreciably reduced as may be noted by comparing the broken line cooling rate 28 of the first example alloy steel to the solid line cooling rate 28' of the second example. The horizontal distance between lines 28 and 28' is indicative of the extra time that is available for the necessary quenching, and it is apparent that much larger articles can be heat treated along the processing route 14' than the route 14.

Hardness readings taken of all four of the lower bainite alloy steel examples set forth above varied generally in magnitude between 55 and 57 on the Rockwell C hardness scale. However, by maintaining the amount of carbon at about 0.70 wt. % and silicon at about 1.50 wt. %, I believe that hardness levels of about 59 on the Rockwell C scale can be consistently attained after the stated heat treat process period of less than two hours.

Notched tensile strength test specimens were machined from bars of the first and second example alloy steels having 0.5" diameter (12.7 mm) cylindrical neck portion with a 60° V-notch centrally thereabout, and with the notch having a depth of about 0.357" (9.07 mm) and a notch radius of 0.006" (0.15 mm). The first and second bainite alloy steel test specimens registered notched tensile strength measurements of 1174.5 $M_{pa}$ (170,348 psi) and 1,332.43 $M_{pa}$ (193,246 psi) when heat treated in accordance with the processing routes 14 and 14' respectively. As a comparison, test specimens of the same first and second alloy steel compositions heat treated by quenching the specimens from about the preselected first temperatures 18,18' into a hot oil bath at about 95° C. (205° F.), cooling, and subsequently tempering in a furnace for a period of one hour at about 250° C. (480° F.) were made. Because of such different heat treatment these comparison specimens exhibited a substantially complete martensite microstructures and notched tensile strength measurements of 752.66 $M_{pa}$ (109,160 psi) and 962.27 $M_{pa}$ (139,561 psi) respectively. Thus, the greatly improved notched tensile strength of the bainite alloy steel of the present invention is apparent, with the second example (FIG. 2) alloy composition exhibiting a substantial increase in tensile strength over the first example (FIG. 1).

The amount of retained austenite in the first example lower bainite steel alloy and the first example comparison martensite specimen was not measurable by X-ray diffraction analysis, while the second example lower bainite steel alloy and the second example comparison martensite specimen measured at 5.7 Vol. % and 6.7 Vol. % respectively. This indicates that the increased amount of silicon in the second example alloys tended to stabilize the austenite so that proportionately more was retained, and also that the amount of retained austenite in the method of the present invention can be expected to remain below 10 Vol. %.

An examination of the microstructure of the first example alloy steel indicated a predominantly homogeneous lower bainite structure including cementite ($Fe_3C$) precipitated within the ferrite laths. In comparison, the second example alloy steel with its higher silicon content was of finer homogeneous lower bainite form including epsilon carbide ($Fe_2C$) precipitated within the ferrite lath boundaries.

INDUSTRIAL APPLICABILITY

In view of the foregoing, it can be appreciated that the through-hardened, low temperature bainitic alloy steel of the present invention exhibits physical properties that could be extremely useful for a wide number of applications including gears, bushings, bearings and the like. Particularly, it exhibits the potential for use in a power train gear having a plurality of teeth thereon for increasing gear static strength to a level of magnitude of 50%, reducing gear distortion by a level of magnitude of 75%, and maintaining equivalent pitting resistance when compared to conventional carburized and hardened steel gears at a minimal increase in cost. The subject lower bainite alloy steel is economical to produce, yet is adaptable to manufacturing procedures requiring no natural gas, for example. Moreover, the entire thermal transformation time is less than about two hours. This has been made possible to a considerable extent by preselected combinations of alloying elements which have resulted in shifting the transformation start curve 10 to the right sufficient for allowing practically attainable rates of cooling for the solution, in so positioning the completion curve 12 as to reduce holding time, and in lowering the $M_s$ line 24 to achieve the desired high level of hardness. For example, by the addition of carbon alone the $M_s$ line is lowered about 35° C. (60° F.) per 0.01 Wt. % carbon to desirably allow the transformation to be achieved at relatively lower temperature. Furthermore, the preselected amount of boron indicated is believed to increase the time available to lower the temperature of the article being quenched to the transformation temperature, and the amount of molybdenum has a significant effect in reducing the holding time required to complete isothermal transformation to lower bainite. Significantly too, all of the preselected elements, except boron, lower the $M_s$ line.

Other aspects, objects and advantages of this invention can be obtained from a study of the drawings, the disclosure and the appended claims.

I claim:

1. A method of making a low temperature bainite steel alloy gear comprising:

Step (a) forming a gear having a plurality of gear teeth thereon of alloy steel consisting essentially of carbon in the range of 0.60 to 0.80 wt. %, manganese in the range of 0.45 to 1.00 wt. %, silicon in the range of 0.15 to 2.20 wt. %, and molybdenum in the range of 0.40 to 0.70 wt. %, preferably but not essentially boron, and the balance substantially iron;

Step (b) heating the gear to a preselected first temperature forming a substantially complete austenite morphology;

Step (c) quenching the gear toward a preselected second temperature at a rate sufficient to avoid transformation until a preselected lower range of temperatures is reached; and Step (d) holding the gear at the second temperature for less than about two hours and transforming the morphology thereof directly from austenite to substantially complete lower temperature bainite.

2. The method of claim 1 wherein step (a) includes selecting the chemical elements of the gear to include boron in the range of 0.0003 to 0.004 wt. %.

3. The method of claim 1 wherein said preselected second temperature (26) is limited to less than about 15° C. above or below the martensite start line (24) for the composition selected.

4. The method of claim 1 wherein said preselected second temperature (26) can vary in a range of about 250° to 350° C.

5. The method of claim 1 wherein step (b) includes immersing the gear in a chloride salt bath, and step (c) includes quenching the gear in a nitrate-nitrite salt bath.

6. The method of claim 1 wherein step (d) includes obtaining a gear hardness level in excess of $R_c$56 uniformly therethrough.

* * * * *